US009984797B2

(12) United States Patent
Tung et al.

(10) Patent No.: US 9,984,797 B2
(45) Date of Patent: May 29, 2018

(54) HIGH VOLTAGE (HV) IMPEDANCE DEVICE WITH SURFACE LEAKAGE PROOF CONFIGURATION APPLIED IN HV DIVIDER

(71) Applicant: ELMATEK INTERNATION CORP., San Jose, CA (US)

(72) Inventors: Kung-Chao Tung, Taipei (TW); Steven Po-Cheng Tung, San Jose, CA (US)

(73) Assignee: ELMATEK INTERNATION CORP., San Jose, CA (US)

( * ) Notice: Subject to any disclaimer, the term of this patent is extended or adjusted under 35 U.S.C. 154(b) by 139 days.

(21) Appl. No.: 15/154,309

(22) Filed: May 13, 2016

(65) Prior Publication Data

US 2017/0330655 A1 Nov. 16, 2017

(51) Int. Cl.
*H01C 1/026* (2006.01)
*H01C 13/00* (2006.01)

(52) U.S. Cl.
CPC ..... *H01C 1/026* (2013.01); *H01C 13/00* (2013.01)

(58) Field of Classification Search
CPC ..... H01C 1/026; H01C 13/00; H02B 13/00
USPC ..... 338/231, 234, 241, 270, 274, 303
See application file for complete search history.

(56) References Cited

U.S. PATENT DOCUMENTS 3,688,238 A * 8/1972 Brady ..... H01C 1/026 174/50.61
3,869,691 A * 3/1975 Stunkard ..... H01C 1/026 338/231
4,638,285 A * 1/1987 Lott ..... H01C 1/082 338/21
5,118,921 A * 6/1992 Aota ..... F23Q 7/001 123/145 A
2013/0293343 A1* 11/2013 Xu ..... H01C 1/14 338/269

* cited by examiner

*Primary Examiner* — Kyung Lee
*Assistant Examiner* — Iman Malakooti
(74) *Attorney, Agent, or Firm* — Chun-Ming Shih

(57) ABSTRACT

A high voltage impedance device with surface leakage proof configuration is applied in a divider. Aforementioned divider is assembled by a high impedance element, an inner case body and an outer case body. The high impedance element is sealed in the inner case body and a closed interlayer between the inner case body and the outer case body is filled with noble gas as an insulating layer. While the high impedance element is applied in high voltage, the closed interlayer can prevent the current-leakage from forming impedance paralleled with the high impedance element. The current-leakage is formed on the surface of insulting portion, or is formed by moisture, dust or corona effect. Therefore, the current-leakage proof divider may maintain the stability/linearity of the voltage division and then reduce the distance between two ends of the high impedance element effectively and still maintain the linearity of measuring voltage.

12 Claims, 14 Drawing Sheets

HIGH VOLTAGE (HV) IMPEDANCE DEVICE WITH SURFACE LEAKAGE PROOF CONFIGURATION APPLIED IN HV DIVIDER

BACKGROUND OF THE INVENTION

1. Field of the Invention

The present disclosure relates to a high voltage (HV) impedance device, particularly a HV impedance device with surface leakage proof configuration applied in a HV divider.

2. Description of the Prior Art

For high voltage equipment, the output voltages based on the voltage division rule are derived from a high-voltage (HV) impedance device in which there are several high impedance units installed in series for measuring high voltage and calculating required voltage values. However, leakage current will be detected at a high impedance unit installed in a humid or dusty environment when voltage applied at both ends of the high impedance unit is increased gradually and up to a certain level. Moreover, a parallel circuit induced by both the leakage current and the high impedance unit has a negative effect on measured voltage which may be deviated from linearity with higher voltage applied. Therefore, a HV impedance device restricted to applications of specific voltages is large enough for linearity of output voltages based on the voltage division rule and assembled in a HV divider which features a dramatic height and other drawbacks such as delivery or movement inconvenient or collapse.

With the drawbacks summarized, how to design a compact HV impedance device for linearity of measured voltages is an important technical issue.

SUMMARY OF THE INVENTION

To solve above problems, the present disclosure offers a high voltage (HV) impedance device without leakage current in high-voltage operation.

In the prior arts to measure voltage values of high-voltage equipment, a HV divider is installed between a measuring point and the reference voltage and internally provided with multiple series-connected high impedance units through which low DC voltages based on the voltage division rule are derived for measurement of high DC voltages wherein each of the multiple high impedance units can be connected to a compensation circuit in parallel for measurement of high AC voltages.

With high voltage applied at both ends of a HV divider, leakage current induced by the high voltage is detected at the surface of the insulating case of the HV divider and leakage current attributed to humid or dusty environment or the corona effect is generated at two end points. In this regard, the leakage current is equivalent to generation of parasitic resistance which coordinates high impedance units inside a HV divider to induce a parallel effect. The parallel effect aggravating resistance with voltage applied increasingly worsens linearity of voltages measured in a HV divider. To solve this problem, engineers extend the length between two end points of a conventional HV divider and increase resistance of external environment for no surface leakage current. Thus, a conventional HV divider is long enough for linearity of output voltages but criticized because of some drawbacks such as movement inconvenient and collapse.

To avoid these drawbacks, the present disclosure offers a HV impedance device with surface leakage proof configuration applied in a HV divider. The HV impedance device comprises a high impedance unit, an inner case and an outer case: the high impedance unit is held in the inner case; the inner case and the outer case are insulators between which some interlayers with inert gas filled inside are developed and sealed for isolation. When high DC voltage is applied at both ends of the high impedance unit, the parallel effect, which could be activated by the high impedance unit inside the inner case and leakage current induced at an insulator's surface by the high voltage as well as leakage current attributed to other factors such as humid or dusty environment and corona effect, is inactive because of isolation of inert gas inside interlayers. Thus, with the length of a high impedance unit lowered effectively, the linearity of output voltages based on the voltage division rule is still maintained and the height of a HV impedance device in an identical high-voltage condition is further reduced for convenient movement and applications.

The high impedance unit inside the inner case of a HV impedance device with surface leakage proof configuration applied in a HV divider in the present disclosure has one end, which contacts high DC voltage, and the other end, which is connected to a divider resistance element in series for linearity of DC output voltages and measurement of high DC voltages in the HV divider or even measurement of high AC voltages in the HV divider with the high impedance unit (the divider resistance element) and an compensation circuit connected in parallel.

BRIEF DESCRIPTION OF THE DRAWINGS

For a better understanding of the aforementioned embodiments of the invention as well as additional embodiments thereof, reference should be made to the Description of Embodiments below, in conjunction with the following drawings in which like reference numerals refer to corresponding parts throughout the figures.

DETAILED DESCRIPTION OF THE PREFERRED EMBODIMENT

The following description is about embodiments of the present invention; however it is not intended to limit the scope of the present invention.

Figure 1:
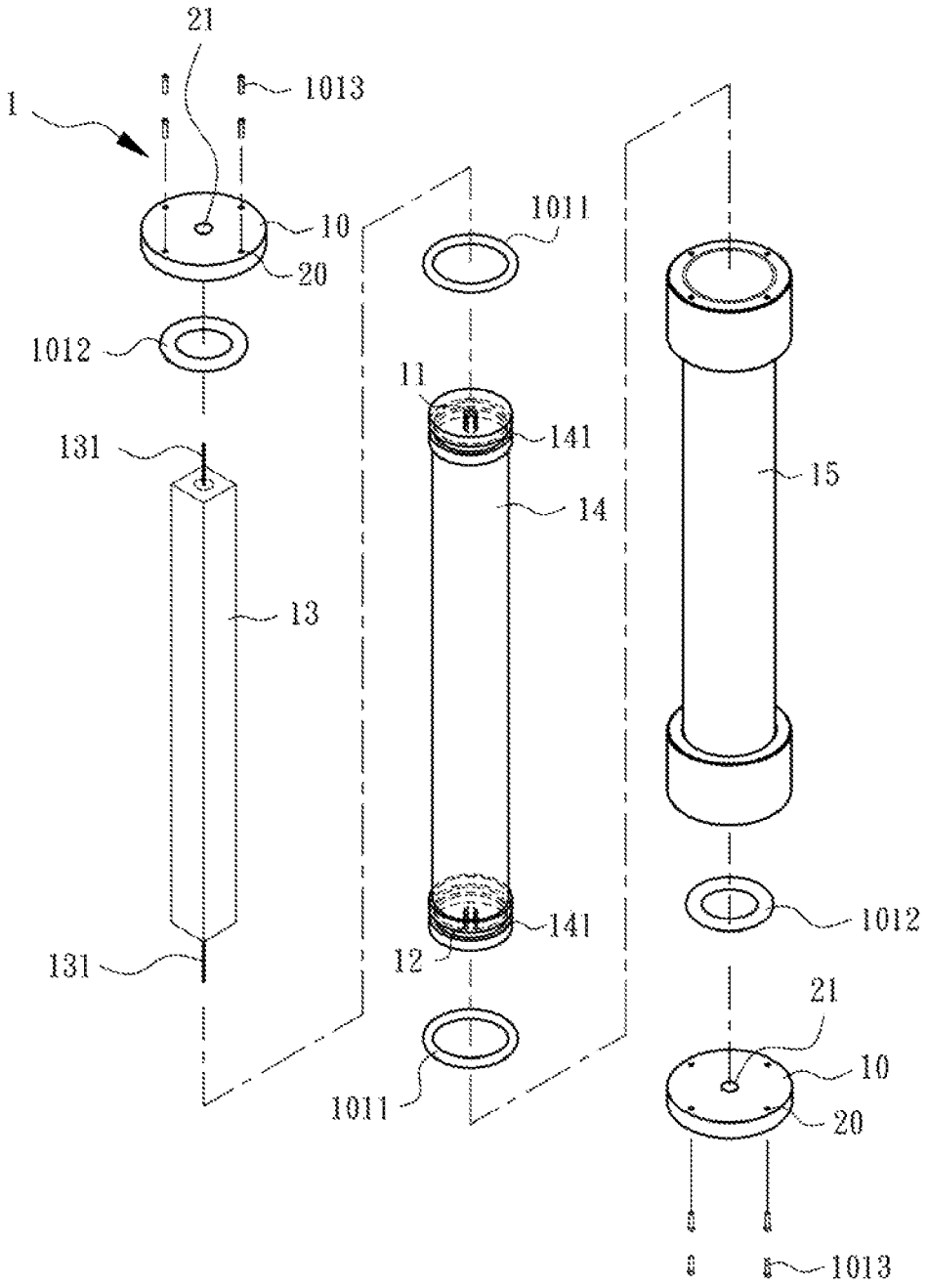
FIG. 1 is an exploded schematic view of a HV impedance device in an embodiment.
Figure 2:
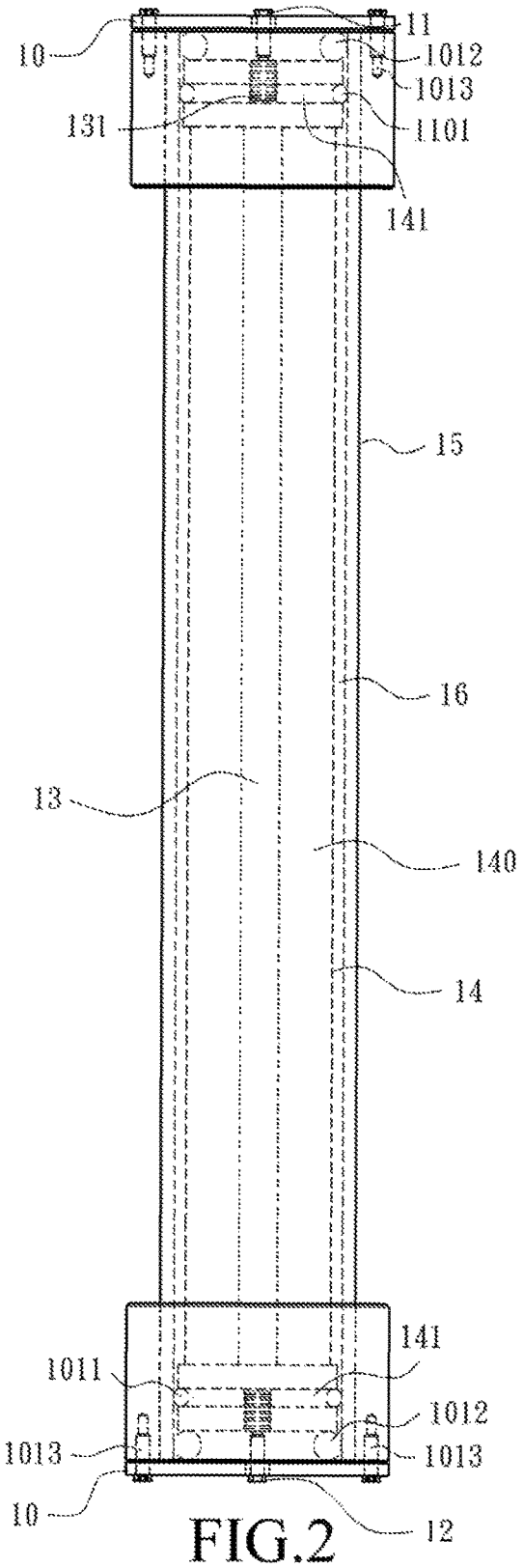
FIG. 2 is a schematic view of an assembled HV impedance device in an embodiment.

Refer to FIG. 1 which is an exploded schematic view illustrating a high voltage (HV) impedance device 1 with surface leakage proof configuration applied in a HV divider in an embodiment. The HV impedance device 1 is provided with an inner case 14 and an outer case 15, both of which are insulators, between a first end 11 and a second end 12: the inner case 14 is a hollow tube (for example, a cylindrical tube) with an inner space 140 in which a high impedance unit 13 is installed and an insulating material 140 or inert gas is filled (FIG. 2); the outer case 15, which is a hollow tube (for example, a cylindrical tube) with outer diameters at both ends greater than outer diameters of other tubes, is integrated with the inner case 14 for development of a gap taken as a closed interlayer 16 (FIG. 2) to prevent leakage current at end points between the inner case 14 and the outer case 15.

The gap between the inner case 14 and the outer case 15 is an enclosed space with sealing units (for example, O-rings) or sealing materials filled at both ends of the inner case 14 and the outer case 15 for a sealing function; a groove 141 is configured at each of two ends of the inner case 14 for coupling of a first sealing unit 1011 so that an enclosed space, the interlayer 16 in which inert gas such as sulfur hexafluoride (SF6) is filled for performance of anti-interference, reduced surface leakage current at the activated high impedance unit 13, and surface resistance between two end points, is developed by the inner case 14 and the outer case 15. The high impedance unit 13 is not limited to either a single high resistor or multiple high resistors installed in series; a second sealing unit 1012 is added between a cover 10 and an end point of the inner case 14 for development of multiple inter-layers 16 and effective prevention of leakage current between two end points (the first end 11 and the second end 12).

The first end 11 and the second end 12 are electrically connected to one of conductive points 131 on the high impedance unit 13, respectively. Moreover, the HV impedance device 1 is provided with a cover 10 which is located at the first end 11 (the second end 12) and has five openings, one at the center (contact opening 21) and four (openings 20) at the edge, by which each of the two covers 10 is fastened at one end of the outer case 15 with the openings 20 penetrated by fixing elements 1013 (for example, screws or bolts), wherein the outer case 15 has four mounting holes at rims of two ends which are opposite to the four openings 20 at the edge of the cover 10 for secure connection, fastening, and better stability of the first end 11 (the second end 12).

The high impedance unit 13 consists of multiple high resistors (over 100MΩ for each) installed in series and withstanding voltage up to 10 kV.

A conventional high-voltage impedance DC divider is provided with a long case between two high-resistance end points (the first end 11 and the second end 12) for preventions of surface resistance at the case between two high-resistance end points under high voltage and the parallel effect attributed to surface resistance and high resistance, reducing the high resistance directly, and worsening linearity of measured output voltages based on the voltage division rule. In the present disclosure, a HV impedance device 1 with surface leakage proof configuration applied in a HV divider prevents leakage current because of an insulated structure developed by the inner case 14, inert gas inside the interlayer 16, the outer case 15 and the covers 10. With identical high voltage applied between the conductive points 131, the HV impedance device 1 with surface leakage proof configuration is characteristic of a compact overall length and a downsizing effect compared with other conventional high-voltage impedance dividers.

Figure 3:
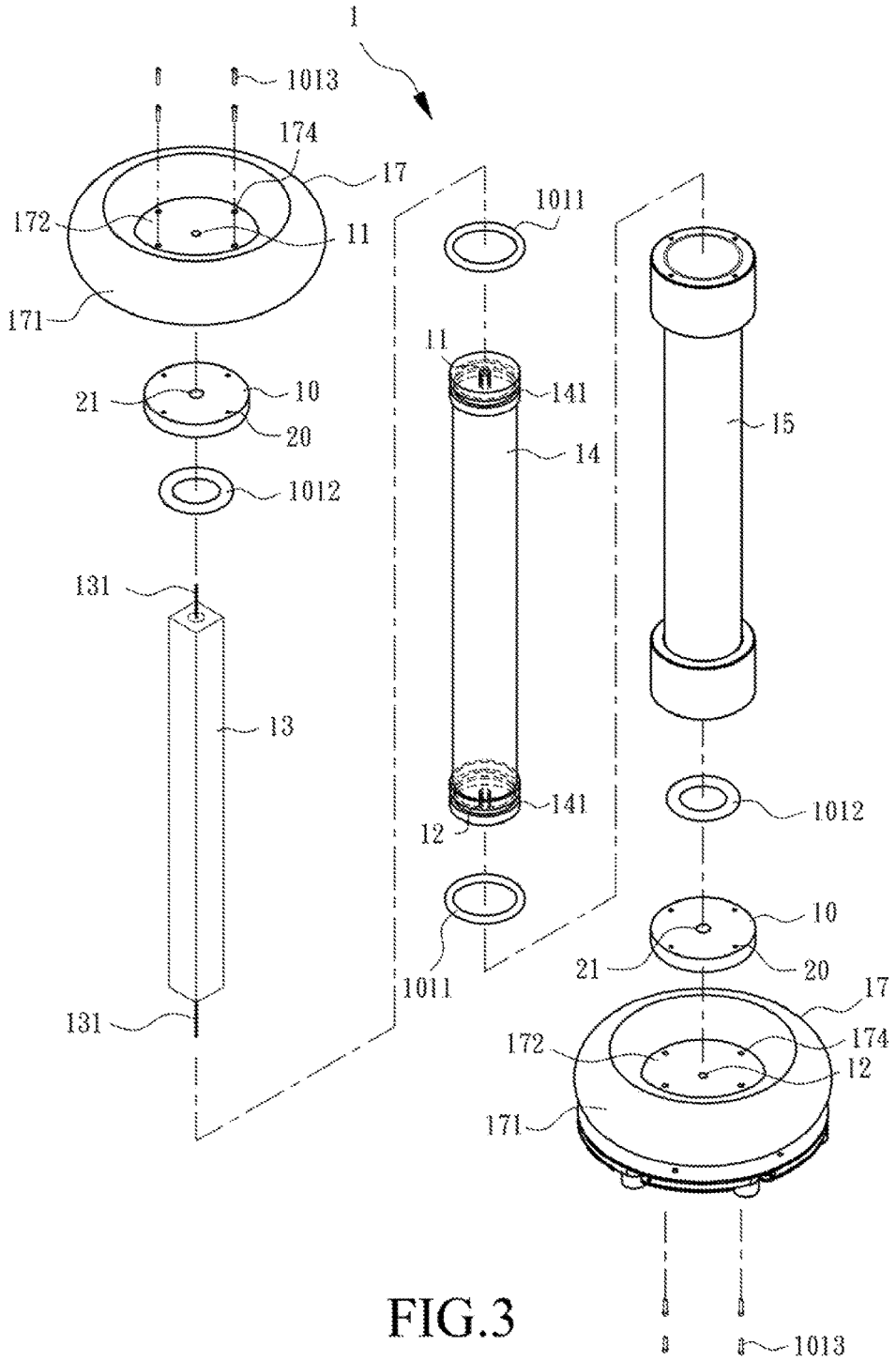
FIG. 3 is another exploded schematic view of a HV impedance device in an embodiment.

Refer to FIG. 3, which is a schematic view of the HV impedance device 1 applied in a HV divider in another embodiment. In the embodiment, the HV impedance device 1 is provided with two end-point protecting units 17 at two end points (the first end 11 and the second end 12), respectively: the end-point protecting unit 17 is a component made of a conductive material and consisting of a hollow circular and tubular protecting ring 171 and a tabular protecting board 172 that is surrounded by the protecting ring 171 and has five openings, one at the center through which one of the two end points (the first end 11 and the second end 12) as well as the high impedance unit 13 are linked and other four openings 174 at the rim; the five openings are opposite to the five openings 20 on the cover 10 and used to fix the protecting unit 17 on the second end 12 of the outer case 15 through four fixing elements 1013.

Figure 4:
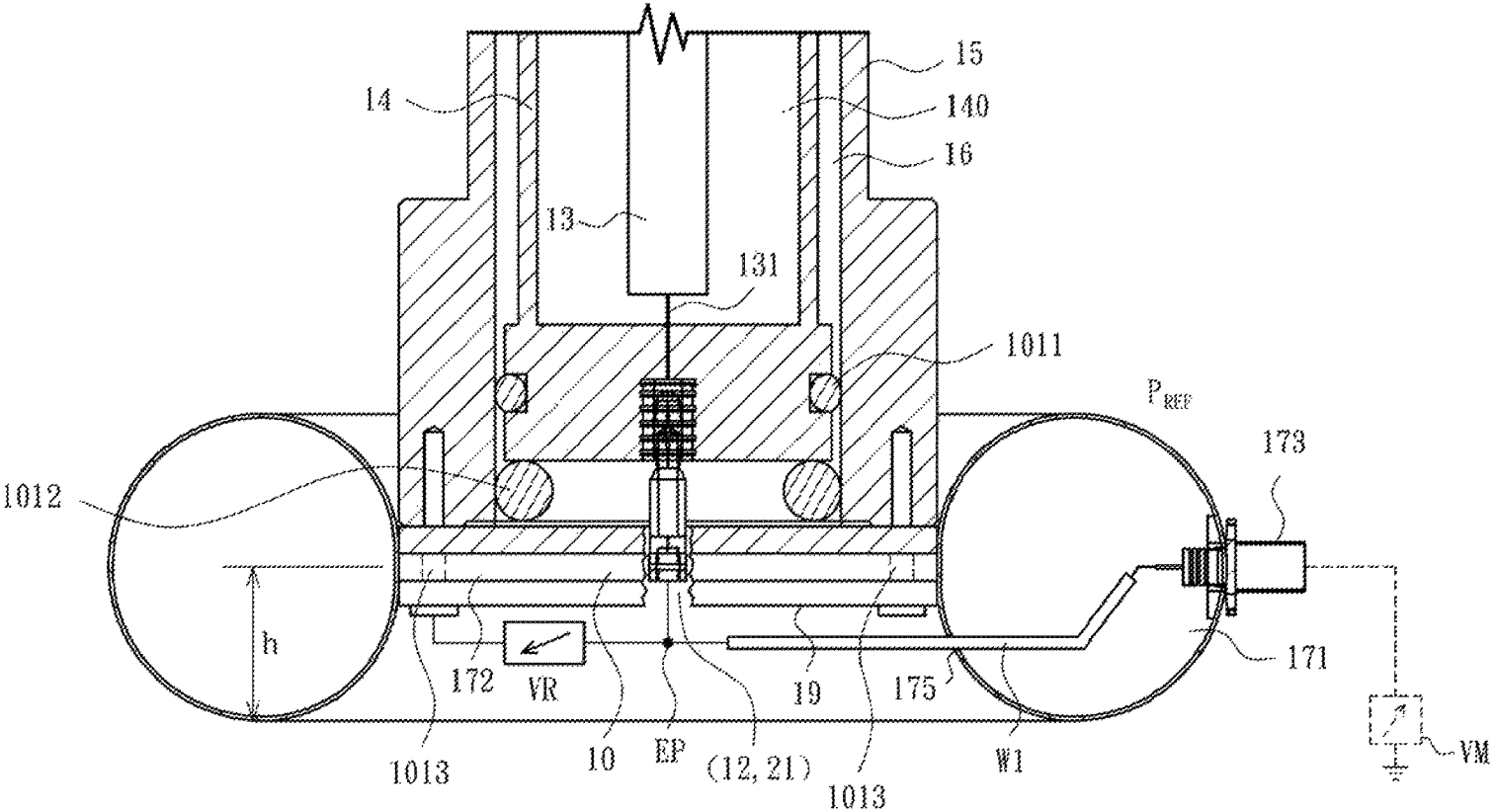
FIG. 4 is a sectional view for the second end at the bottom of a HV impedance device applied in a HV divider in an embodiment.

Refer to FIG. 4, which is a sectional view for the second end 12 at the bottom of the HV impedance device 1 applied in a HV divider in an embodiment. As shown in FIG. 4, the conductive point 131 at one end of the high impedance unit 13 inside the inner case 14 is extracted from the center (contact opening 21) on the cover 10 and the center of the protecting board 172 and taken as an end portion $E_P$ which is connected to one end of a variable resistor VR (or a semi-variable resistor) at a circuit board 19 fixed on the protecting board 172. The variable resistor VR has the other end connected to the protecting ring 171 at which a reference voltage $P_{REF}$ is set for development of a series circuit by the variable resistor and the high impedance unit 13. On the protecting ring 171, there are two openings on the circular tubular side, one opening (opening 175) for a current lead introduced and connected to an end portion $E_P$ and the other opening in which a BNC connector 173 at the other end of the current lead is embedded, so that a contact extracted from the BNC connector 173 is created for direct voltage measurement by a voltmeter (as shown in a dotted line in FIG. 4) or output from an end portion $E_P$ via a connected coaxial cable. The height of the circular and tubular protecting ring 171, h, is above the end portion $E_P$ and the variable resistor for no contact interference induced by a foreign object during voltage measurement. The current lead is wrapped by an insulating layer for no short circuit at the end portion $E_P$ or the protecting ring 171.

Figure 5:
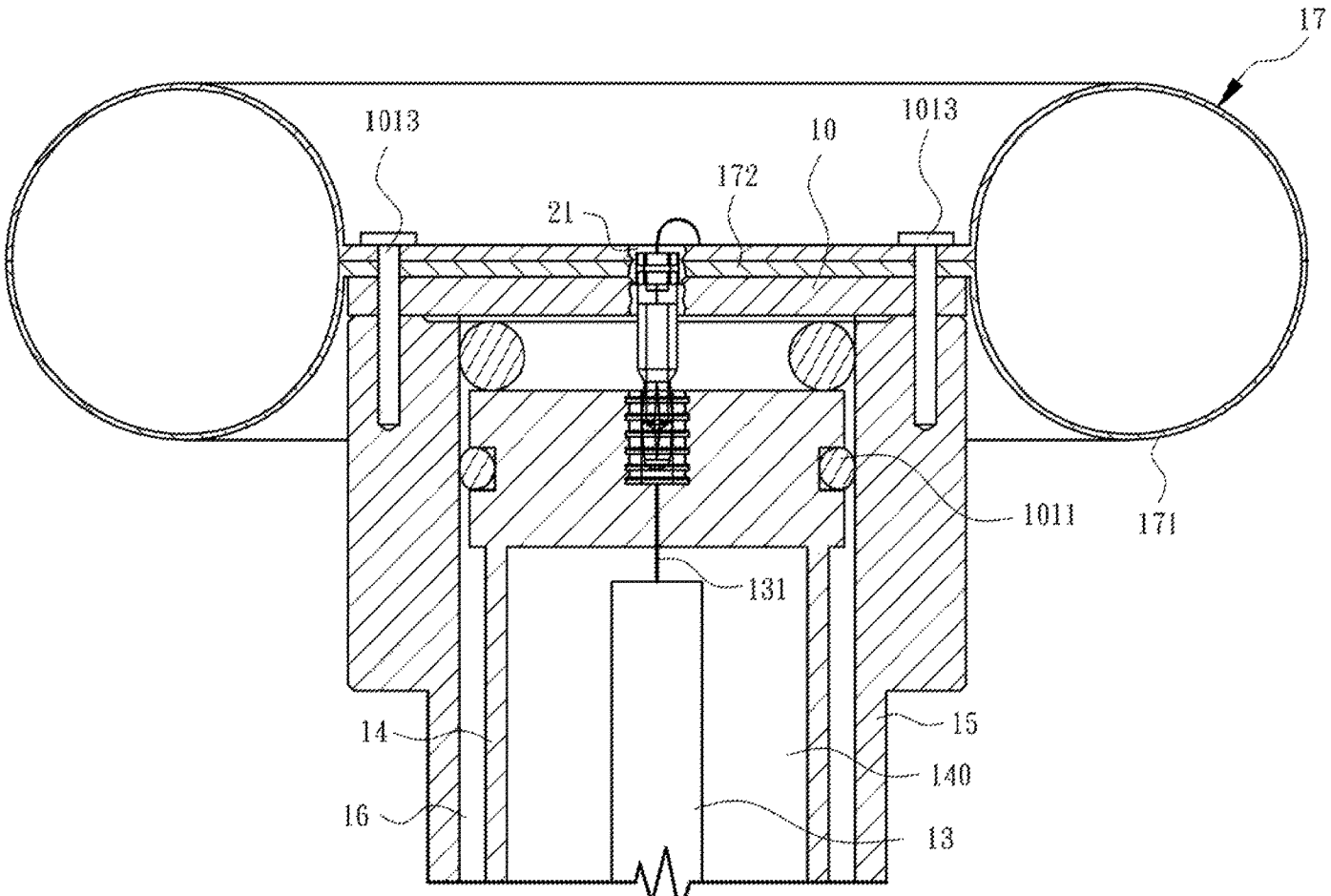
FIG. 5 is a sectional view for the first end at the top of a HV impedance device applied in a HV divider in an embodiment.

Refer to FIG. 5, which is a sectional view for the first end 11 at the top of the HV impedance device 1 applied in a HV divider in an embodiment. As shown in FIG. 5, the center of the protecting board 172 surrounded by the protecting ring 171 allows the first end 11 and the high impedance unit 13 to be conductively connected to the end-point protecting unit 17 for convenient contact between the protecting ring 171 and measured high voltage wherein the end-point protecting unit 17 is fixed on the first end 11 in the outer case 15 when the openings 20 and the corresponding openings 174 on the protecting board 172 are penetrated by the fixing elements 1013.

Figure 6:
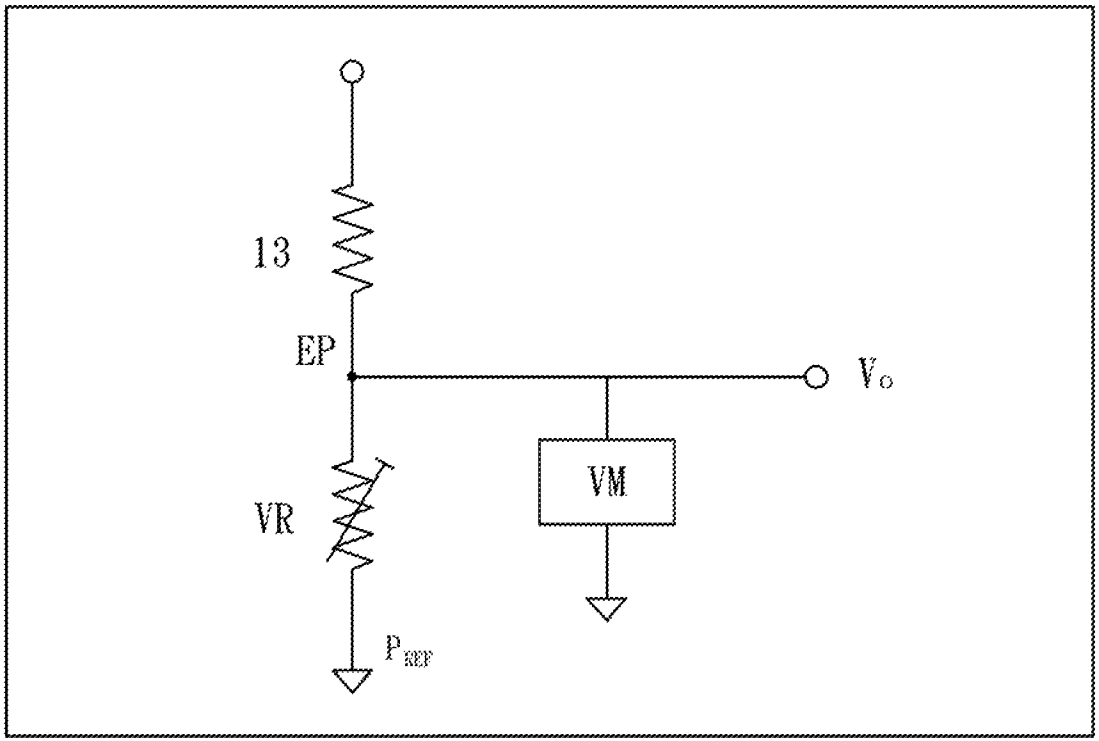
FIG. 6 is an equivalent circuit diagram for a HV impedance device applied in a HV divider in an embodiment.

Refer to FIG. 6, which is a DC equivalent circuit diagram for the HV impedance device 1 applied in a HV divider in an embodiment. As shown in the DC equivalent circuit diagram, the high impedance unit 13 links the variable resistor in series and further the reference voltage $P_{REF}$ for measurement of high voltage $V_0$ with a digital or analogue voltmeter VM installed between an end point and the end portion $E_P$.

Figure 7:
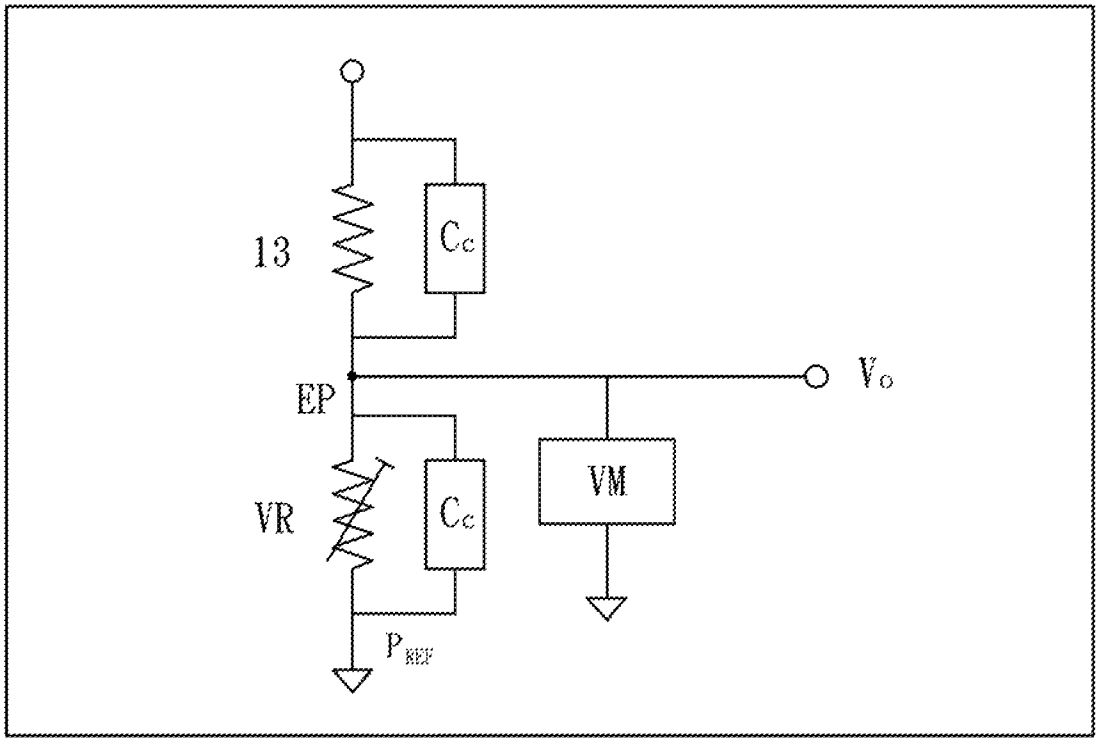
FIG. 7 is another equivalent circuit diagram for a HV impedance device applied in a HV divider in an embodiment.

Refer to FIG. 7, which is an AC equivalent circuit diagram for the HV impedance device 1 applied in a HV divider in an embodiment. As shown in the AC equivalent circuit diagram with architecture similar to the DC equivalent circuit diagram, the measurement of high AC voltage $V_0$ is available in the HV impedance device 1 when the high impedance unit 13 (the variable resistor VR also) and a resistance compensation element Cc (for example, a frequency compensation element including capacitors or inductors) are connected in parallel.

Figure 8:
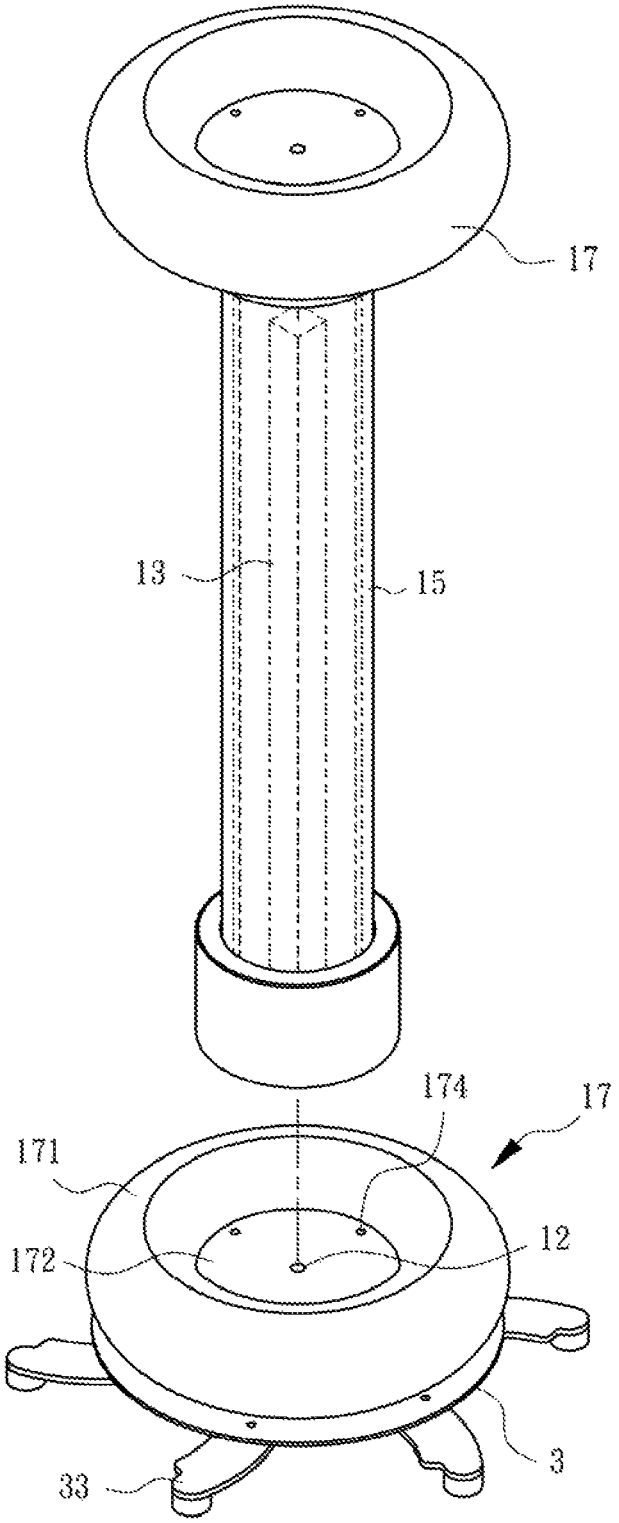
FIGS. 8 and 9 are schematic views of a HV impedance device applied in a HV divider and comprising a shrink foot device in an embodiment.
Figure 9:
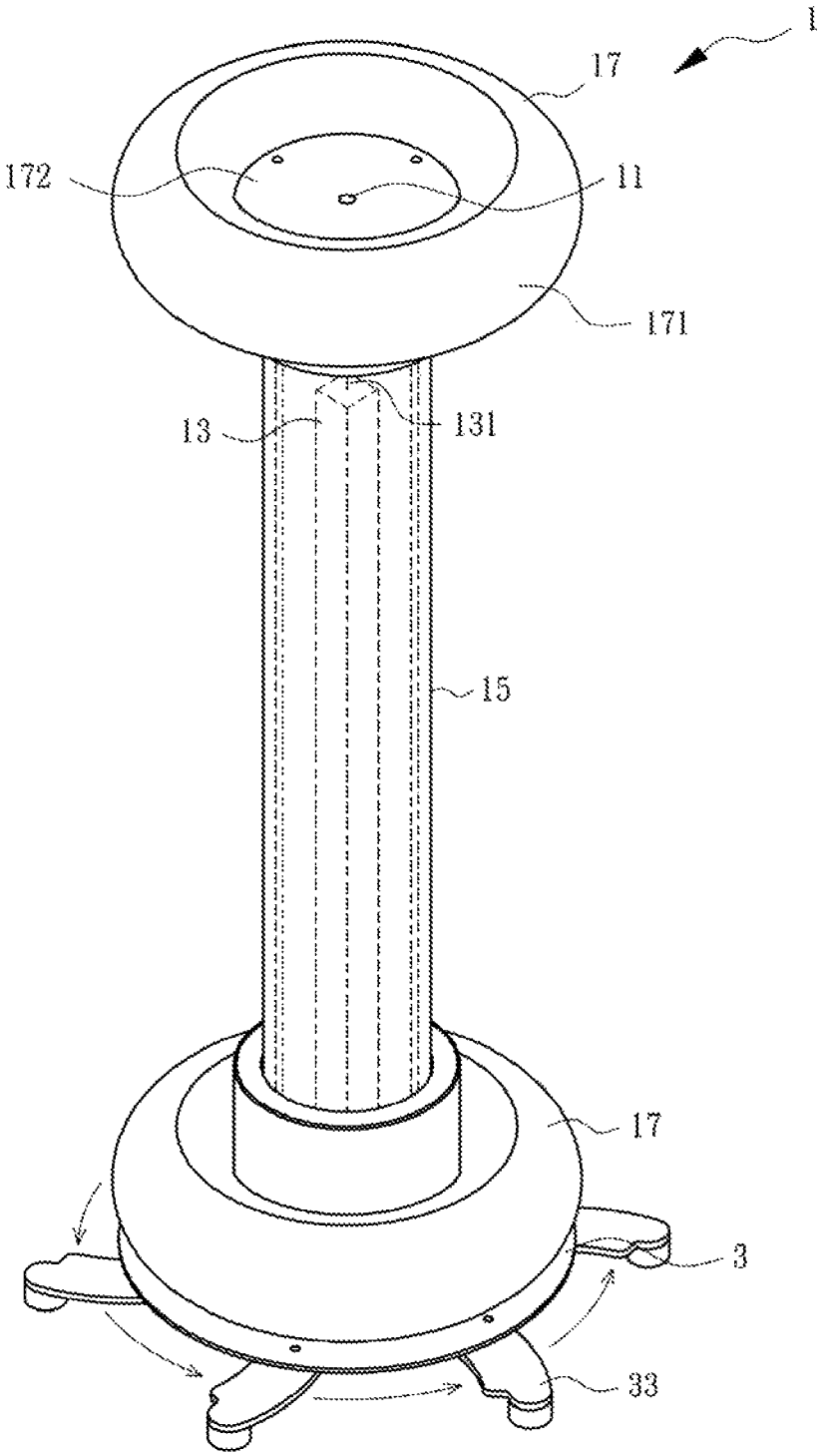

Referring to FIGS. 8 and 9, the HV impedance device 1 applied in a HV divider in another embodiment comprises a shrink foot device 3 linking the bottom of the circular and tubular protecting board 172 at the second end 12 and having a plurality of shrink feet 33, each of which has one end pivotally fitted at the shrink foot device 3 and is stretched or retracted horizontally when force is applied on the shrink foot 33. Because of the shrink feet 33 stretchable/retractable horizontally, the HV impedance device 1 can be operated stably and supported in a horizontal direction particularly with the shrink feet 33 stretched.

With high voltage applied at both ends, the voltage at each ohmic contact in a conventional HV impedance device is greater than voltage in environment, particularly in a humid or dusty workplace in which a leakage path is easily generated from an ohmic contact to external environment and has negative effects such as poor stability of output voltages based on the voltage division rule or parasitic resistance in parallel among ohmic contacts. Different from a conventional HV impedance device, the HV impedance device 1 with the high impedance unit 13 surrounded and protected by inert gas inside a closed interlayer 16 (FIG. 3) and isolated from leakage current is characteristic of a reduced height of a HV divider and good linearity of measured voltages under same external environmental conditions.

Figure 10:
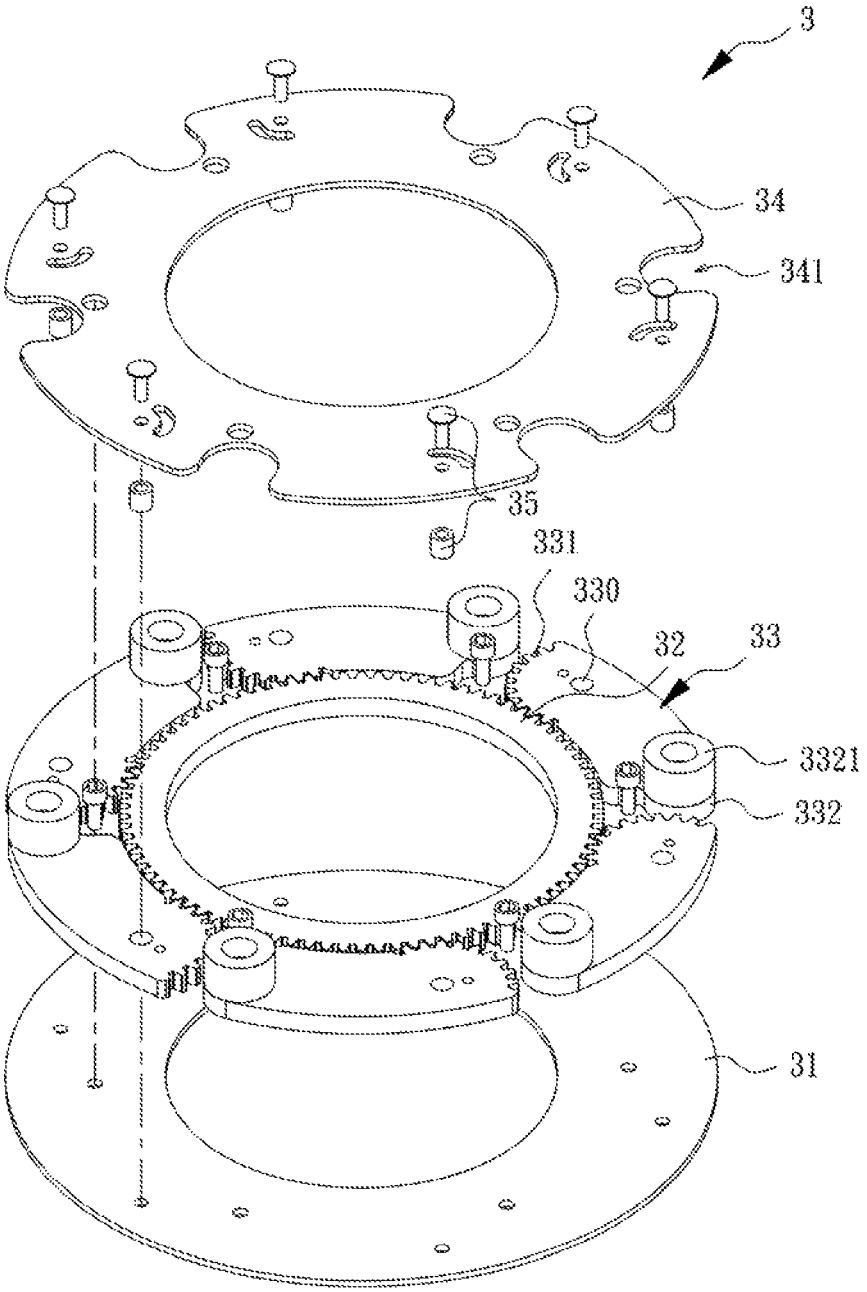
FIG. 10 is an exploded schematic view of a shrink foot device in an embodiment.

Refer to FIG. 10, which is an exploded schematic view of the shrink foot device 3 in the first embodiment. The shrink foot device 3 comprises a base board 31, a gear 32, a plurality of shrink feet 33 and a base cover 34. The base board 31 comprises several connecting portions (for example, sockets) thereon for connecting shrink feet 33; the gear 32, which is placed on one plane of the base board 31, is driven by the shrink feet 33 for rotation relative to the base board 31; each shrink foot 33 comprises a pivot end 330 (FIG. 11), which is pivotally fitted at a connecting portion of the base board 31 through connectors 35 for swing of the shrink foot 33, and a gear end 331, which is defined and engaged with the gear 32 partially for a plurality of shrink feet 33 surrounding the gear 32 peripherally; each shrink foot 33 with the other end defined as an extremity end 332 can be swung and drive the gear 32 to rotate itself and further activate other shrink feet 33 for leaving or approaching the gear 32.

The base cover 34 is mounted on the gear 32 and the shrink feet 33; both the gear 32 and the shrink feet 33 between the base cover 34 and the base board 31 are connected to the connecting portions (sockets) on the base board 31 with connectors 35 (a screw/nut unit or rivets), held in a storage space developed by the base cover 34 and the base board 31, and placed on an identical plane. In another embodiment, the base board 31 has an annular exterior which matches the gear 32 with a ringlike shape as well as the shrink feet 33 coupled with the gear 32 in a closing mode.

Figure 11:
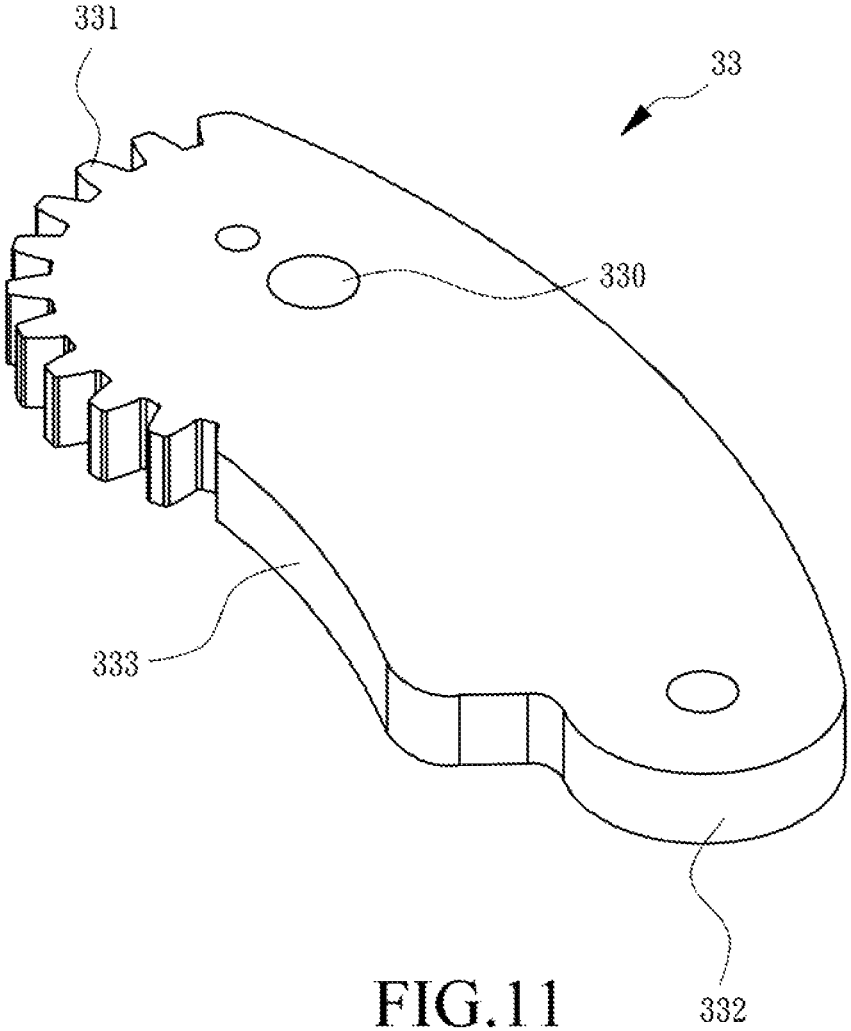
FIG. 11 is a perspective schematic view of a shrink foot installed in a HV impedance device.

Refer to FIG. 11, which is a perspective schematic view of a shrink foot 33 in the present disclosure. The pivot end 330 of each shrink foot 33 is pivotally fitted at the base board 31 through connectors 35 (for example, a pivotal screw and a retaining nut) and adjacent to the gear end 331 of the shrink foot 33; each shrink foot 33 has an arc-shaped inner side 333 leaning on the periphery of the gear 32 in a closing mode; the gear end 331 is a curved structure driving the gear 32 to rotate in an opening mode.

In another embodiment, each shrink foot 33 comprises a pad body 3321 on one plane of the extremity end 332; relatively, the base cover 34 comprises a plurality of placing openings 341 indenting from the rim for holding the pad bodies 3321 in a closing mode.

Figure 12:
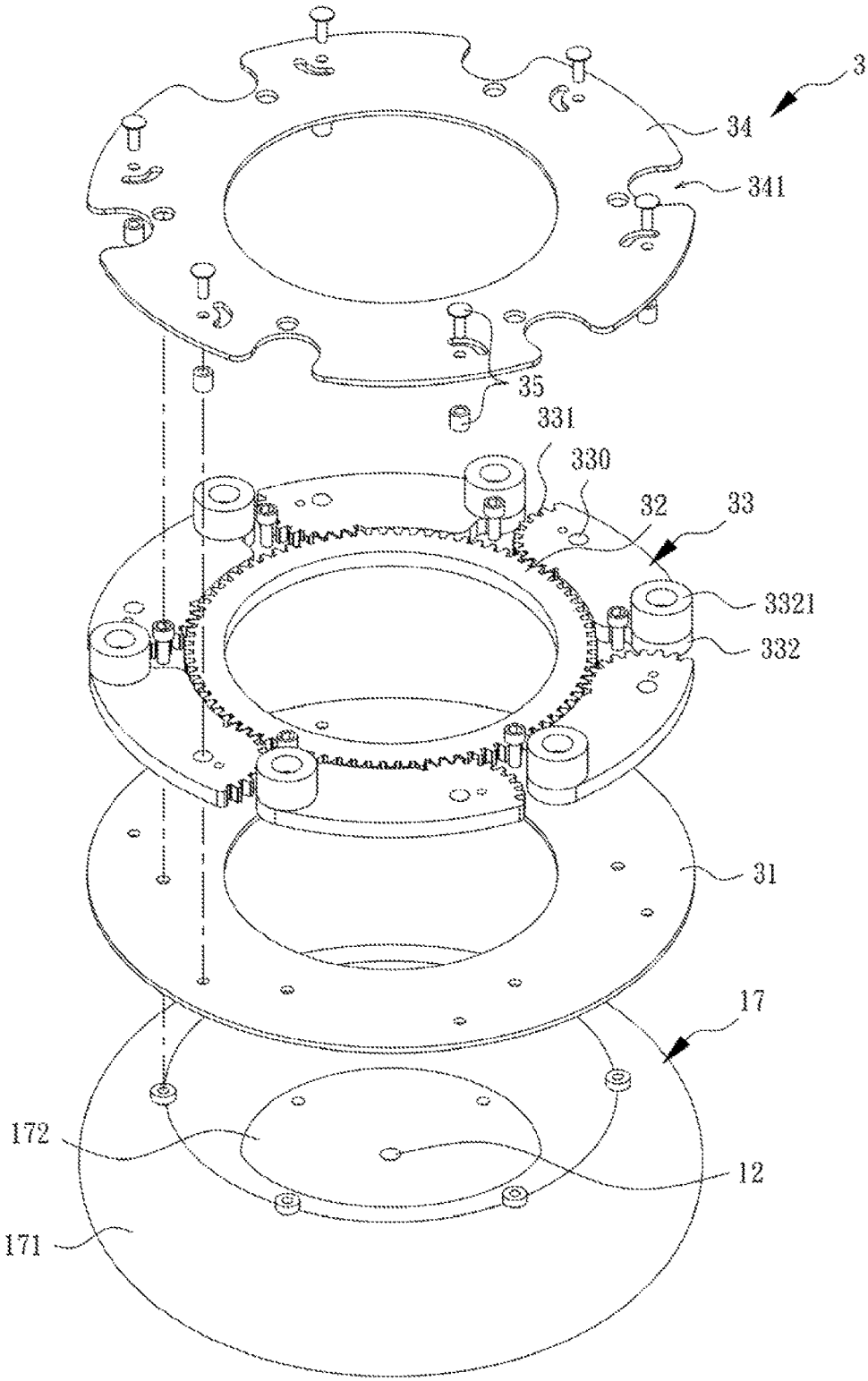
FIG. 12 is an exploded schematic view of an end-point protecting unit and a shrink foot device in a HV impedance device.

Furthermore, the base board 31 has the other plane fixed at another device through contacts. Refer to FIG. 12, which is an exploded schematic view of the shrink foot device 3 in the second embodiment. In the second embodiment similar to the first embodiment, the shrink foot device 3 further comprises an end-point protecting unit 17 mounted on the other plane of the base board 31 and comprising the protecting ring 171 and the protecting board 172 on which some ohmic contacts are designed.

Figure 13:
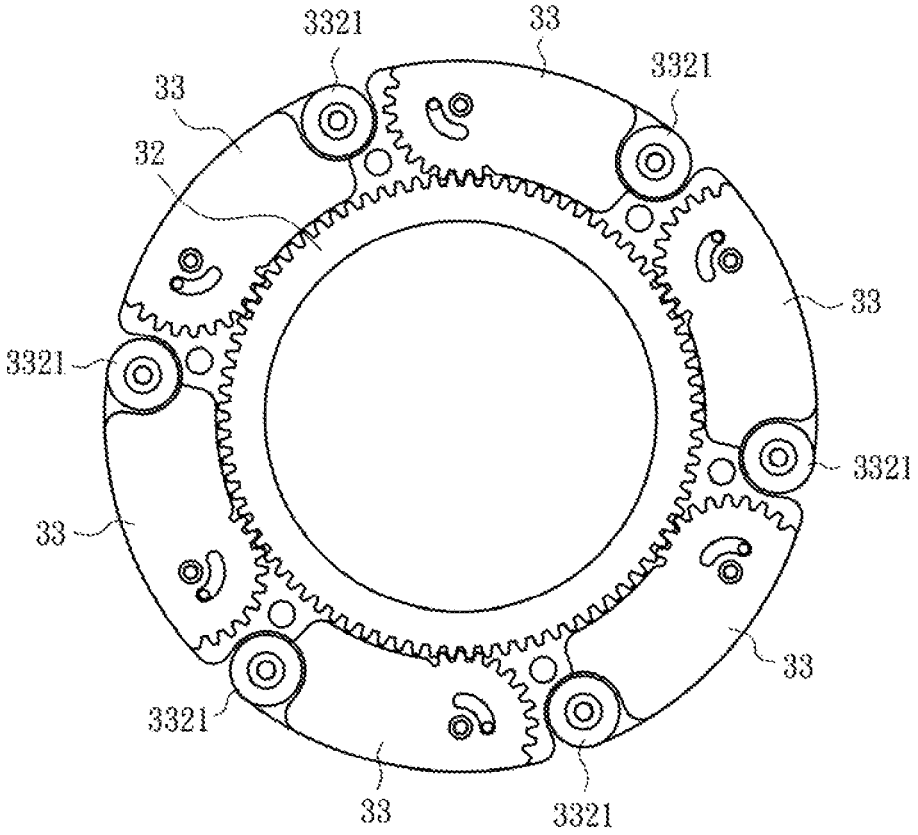
FIG. 13 is a schematic view of a shrink foot device in a closing mode.
Figure 14:
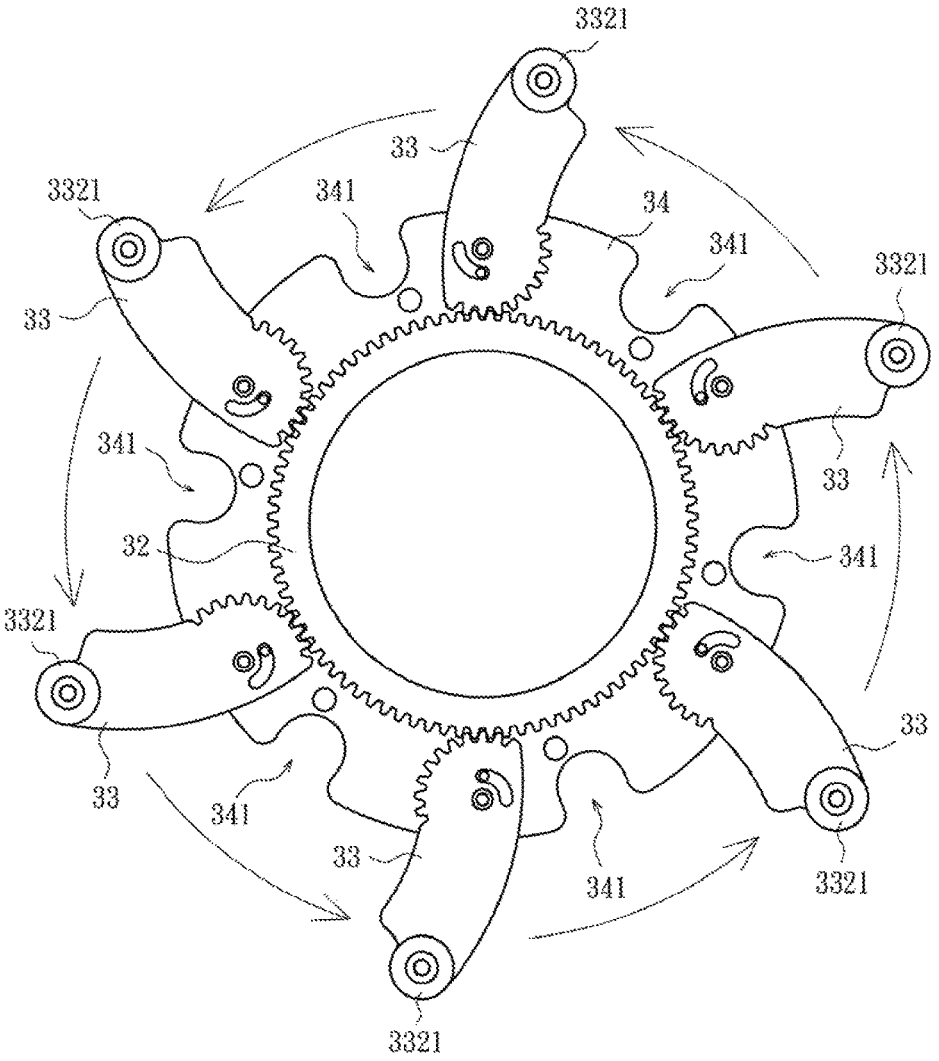
FIG. 14 is a schematic view of a shrink foot device in an open mode.

Refer to FIG. 13, which is a schematic view of the shrink foot device 3 in a closing mode. Referring to FIG. 14, the extremity end 332 of a shrink foot 33 is first swung and extracted from the shrink foot device 3 under control of a user and followed by other shrink feet 33, which are driven and swung by the gear 32 with the gear ends 331 of the shrink feet 33 rotating, for unfolding all shrink feet 33 quickly. On the other hand, to retract the shrink foot device 3, a user needs to swing and push the extremity end 332 of a shrink foot 33 toward the shrink foot device 3 and retract other shrink feet 33 through the gear 32 quickly.

In the present disclosure, the shrink foot device 3 is a footstand of the HV impedance device 1 and connected to one end of the HV impedance device 1 through connectors 35. To remove or place the HV impedance device 1 that is a heavy appliance usually, a user should extract a single shrink foot 33 at first by which other shrink feet 33 are driven and stretched for development of a stable footstand; to retract the shrink foot device 3, a single shrink foot 33 should be pushed into the footstand in which all shrink feet 33 can be held. Thus, the shrink foot device 3 coordinates other devices for better stability of the HV impedance device 1 effectively.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A high voltage (HV) impedance device with surface leakage proof configuration applied in a HV divider, the HV impedance device comprising:

a high impedance unit, comprising one high impedance resistor or a plurality of serially connected high impedance resistors;

an inner case with a hollow tuber structure and insulating body, configured between a first end and a second end of the HV impedance device, wherein the high impedance unit is placed in an inner space of the inner case, an insulating material or inert gas is filled in the inner space, and each end of the inner case is configured with a groove which set with a first sealing unit; and an outer case with a tuber structure and insulating body, configured between the first end and the second end of the HV impedance device, wherein the outer case sleeves onto the inner case, and a closed interlayer is formed and defined by the first sealing unit, the inner case, and the outer case, wherein the closed interlayer is filled with the inert gas;

wherein, two ends of the outer case are assembled with two covers respectively, and a second sealing unit is against the cover and the inner case.

2. The HV impedance device as claimed in claim 1, further comprising an end-point protecting unit configured at each end of the HV impedance device, each the end-point protecting unit comprising a protecting ring with hollow tuber structure and a protecting board with flat plate structure, wherein the protecting ring is surrounded rim of the protecting board, wherein the protecting board connected with the outer case by a fixing element, wherein one conductive point of the high impedance unit is connected to the end-point protecting unit at the first end through opening of the cover at the first end, wherein the other one conductive point of the high impedance unit is connected to one end-portion of a variable resistor configured on a circuit board through opening of the cover at the second end, wherein the circuit board fixed on the protecting board and the other one end of the variable resistor connected with the protecting ring which setting as reference voltage point, wherein the end-portion connected with a connector embedded at the protecting ring at the second end, wherein the configuration and direction of outputted connector is adjust by the actual demand, the shape of the connector is not limited, or the end-portion can be elicited by a coaxial cable.

3. The HV impedance device as claimed in claim 2, wherein the impedance unit and the variable resistance are parallel connected with resistance compensation element so as to measure AC voltage.

4. The HV impedance device as claimed in claim 2, wherein bottom of the end-point protecting unit at the second end is connected with a shrink foot device, comprising:

a base board, comprising a plurality of connecting portion at setting plate;

a gear, configured at the base board and can be rotated with respect to the base board; and a plurality of shrink foots, wherein a pivot end of each shrink foot connected to the connecting portion of the base board by a connector and surrounded the gear, wherein one end of the shrink foot defined as gearing end with a gear structure and geared one portion of the gear, the other end of the shrink foot defined as an extremity end;

wherein the shrink foot can be swing respect to the base board to rotate the gear so as to drive other shrink foots to shrink in horizontal direction when forced is applied on the shrink foot.

5. The HV impedance device as claimed in claim 4, further comprising a base cover configured on the gear and the shrink foots so as to place the gear and the shrink foots in a storage space formed by the base cover and the base board, wherein the base cover is formed a plurality of placing opening from the rim to the inner, wherein the storage opening is used to place a pad body configured at the extremity end of the shrink foot in closing mode.

6. The HV impedance device as claimed in claim 4, wherein one side of the shrink foot surrounded the gear is an arcuate structure so as to attach rim of the gear in closing mode, wherein the gearing end is comprised the arcuate structure so as to drive the gear to rotate in opening mode.

7. The HV impedance device as claimed in claim 4, wherein location of the pivot end is neighbored to location of the gearing end.

8. The HV impedance device as claimed in claim 4, wherein the gear is a ring gear or circular gear.

9. The HV impedance device as claimed in claim 4, wherein the connecting portion is a socket and the connector is a bolt.

10. The HV impedance device as claimed in claim 4, further comprising a base cover, wherein the gear and the shrink foots are configured in a storage space between the base cover and the base board.

11. The HV impedance device as claimed in claim 10, wherein the base cover is connected to the connecting portion of the base board by the connector.

12. The HV impedance device as claimed in claim 11, wherein shape of the base board is a ring or circular structure, the gear is a ring or circular gear, and an assembly structure formed by the gear and shrink foots in closed mode is match shape of the base board.

* * * * *